US009057247B2

(12) United States Patent
Kumar et al.

(10) Patent No.: US 9,057,247 B2
(45) Date of Patent: Jun. 16, 2015

(54) MEASUREMENT OF DOWNHOLE COMPONENT STRESS AND SURFACE CONDITIONS

(75) Inventors: Sunil Kumar, Celle (DE); Hendrik John, Celle (DE); Harald Grimmer, Lachendorf Niedersachsen (DE); Thomas Kruspe, Wietzendorf Niedersachsen (DE); Andreas Peter, Celle Niedersachsen (DE); Michael Koppe, Lachendorf (DE)

(73) Assignee: Baker Hughes Incorporated, Houston, TX (US)

( * ) Notice: Subject to any disclaimer, the term of this patent is extended or adjusted under 35 U.S.C. 154(b) by 502 days.

(21) Appl. No.: 13/401,158

(22) Filed: Feb. 21, 2012

(65) Prior Publication Data

US 2013/0213129 A1 Aug. 22, 2013

(51) Int. Cl.

| | |
|---|---|
| ***E21B 44/00*** | (2006.01) |
| ***E21B 47/00*** | (2012.01) |
| ***E21B 47/01*** | (2012.01) |

(52) U.S. Cl.

CPC ..... *E21B 47/0006* (2013.01); *E21B 47/011* (2013.01)

(58) Field of Classification Search

CPC ..... E21B 47/0006; G01L 5/161; G01L 5/167; G01L 5/165; G01L 5/0033; G01L 15/9983; G01L 15/9983

USPC ..... 73/152.48–152.49

See application file for complete search history.

(56) References Cited

U.S. PATENT DOCUMENTS

| | | | | |
|---|---|---|---|---|
| 3,800,277 | A | 3/1974 | Patton et al. | |
| 4,269,063 | A * | 5/1981 | Escaron et al. | 73/152.59 |
| 4,294,318 | A | 10/1981 | Desbrandes et al. | |
| 4,662,458 | A * | 5/1987 | Ho | 175/27 |
| 4,715,451 | A | 12/1987 | Bseisu et al. | |
| 4,747,456 | A * | 5/1988 | Kitagawa et al. | 177/211 |

(Continued)

FOREIGN PATENT DOCUMENTS

WO 2009043589 A2 4/2009

OTHER PUBLICATIONS

Bandorf, R. et al.; "Development of Me-DLC Films for Strain Gauge Applications," 2009 Society of Vacuum Coaters, 22nd Annual Technical Conference Proceedings, Santa Clara, CA., May 9-14, 2009, pp. 26-30.

(Continued)

*Primary Examiner* — John Fitzgerald

(74) *Attorney, Agent, or Firm* — Cantor Colburn LLP

(57) ABSTRACT

An apparatus for measuring strain on a downhole component includes: at least one strain sensitive device disposed proximate to a surface of a component of a drilling assembly or disposed within a material forming the component; and a processor in operable communication with the at least one strain sensitive device, the processor configured to detect changes in the at least one strain sensitive device and detect at least one of erosion, crack formation and crack propagation in the component surface. An apparatus for measuring strain on a downhole component includes: at least one strain gauge deposited on a surface of a drive shaft or disposed within a material forming the drive shaft; and a processor in operable communication with the at least one strain gauge, the processor configured to detect changes in the at least one strain gauge and detect conditions affecting operation of the drive shaft.

16 Claims, 5 Drawing Sheets

(56) References Cited

U.S. PATENT DOCUMENTS

| | | | | |
|---|---|---|---|---|
| 4,805,449 | A | 2/1989 | Das | |
| 4,811,597 | A * | 3/1989 | Hebel | 73/152.48 |
| 4,812,800 | A * | 3/1989 | Fuchs et al. | 338/2 |
| 4,821,563 | A * | 4/1989 | Maron | 73/152.48 |
| 4,858,710 | A * | 8/1989 | Krause | 177/211 |
| 4,958,517 | A * | 9/1990 | Maron | 73/152.48 |
| 5,184,516 | A * | 2/1993 | Blazic et al. | 73/799 |
| 5,386,724 | A | 2/1995 | Das et al. | |
| 5,705,757 | A | 1/1998 | Wozniak | |
| 5,896,191 | A * | 4/1999 | Beier et al. | 356/35.5 |
| 6,216,533 | B1 * | 4/2001 | Woloson et al. | 73/152.47 |
| 6,269,702 | B1 | 8/2001 | Lambson | |
| 6,404,107 | B1 * | 6/2002 | Lazarus et al. | 310/328 |
| 6,420,867 | B1 * | 7/2002 | Goldfine et al. | 324/242 |
| 6,729,187 | B1 * | 5/2004 | Gregory | 73/760 |
| 6,957,575 | B2 | 10/2005 | Boucher et al. | |
| 7,233,296 | B2 | 6/2007 | Song et al. | |
| 7,234,519 | B2 | 6/2007 | Fripp et al. | |
| 7,325,605 | B2 | 2/2008 | Fripp et al. | |
| 7,793,558 | B2 | 9/2010 | Budde | |
| 7,948,197 | B2 | 5/2011 | Shackelford, IV | |
| 7,963,171 | B2 * | 6/2011 | Gregory et al. | 73/777 |
| 8,011,255 | B2 | 9/2011 | Arms et al. | |
| 8,342,031 | B2 | 1/2013 | Jamshidi et al. | |
| 8,397,562 | B2 * | 3/2013 | Wassell et al. | 73/152.48 |
| 8,438,931 | B2 * | 5/2013 | Kazama et al. | 73/777 |
| 8,695,729 | B2 | 4/2014 | Kumar et al. | |
| 2002/0070050 | A1 | 6/2002 | Wassell | |
| 2003/0150263 | A1 | 8/2003 | Economides et al. | |
| 2003/0183015 | A1 | 10/2003 | Richardson et al. | |
| 2004/0063238 | A1 | 4/2004 | Nagasaka et al. | |
| 2005/0100414 | A1 | 5/2005 | Salama | |
| 2005/0115329 | A1 * | 6/2005 | Gregory et al. | 73/777 |
| 2009/0090176 | A1 | 4/2009 | Toribio et al. | |
| 2009/0173162 | A1 * | 7/2009 | Gregory et al. | 73/777 |
| 2010/0326654 | A1 | 12/2010 | Hemblade | |
| 2011/0024188 | A1 | 2/2011 | Wassell | |
| 2011/0067925 | A1 * | 3/2011 | Underwood et al. | 175/61 |
| 2011/0286304 | A1 | 11/2011 | Thigpen et al. | |
| 2013/0293235 | A1 | 11/2013 | Bloemenkamp et al. | |

OTHER PUBLICATIONS

Bandorf, R. et al.; "High Rate Deposition of Soft Magnetic Thick Films by Gas Flow Sputtering," 2007 Society of Vacuum Coaters, 50th Annual Technical Conference Proceedings (2007), pp. 473-476.

Bandorf, R. et al.; "High Rate Deposition of Magnetic Material by Gas Flow Sputtering," Plasma Processes and Polymers, 2007, 4, pp. S129-S133.

Bedenbecker, M. et al.; "Hard and soft magnetic materials for electromagnetic microactuators," Microsyst Technol, Technical Paper, 2008, 6 sheets.

Brunner "Piezoelectric Thin Film Transducers". Fraunhofer ISC, www.isc.fraunhofer.de. 2 pages.

Brunner "Piezoelectric Transducers for Structural Health Monitoring". Fraunhofer-Institut for Silicatforschung ISC www.isc.fraundofer.de. 2 pages.

Gerdes, H. et al.; "Sputter Deposition of Strain Gauges Using ITO/Ag," Plasma Processes and Polymers, 2009, 6, pp. S813-S816.

Heckmann, U. et al.; "New materials for sputtered strain gauges," Procedia Chemistry 1 (2009), Proceedings of the Eurosensors XXIII conference, pp. 64-67.

Notification of Transmittal of the International Search Report and the Written Opinion of the International Searching Authority, or the Declaration; PCT/US2013/026845, Jul. 17, 2013, 13 pages.

* cited by examiner

MEASUREMENT OF DOWNHOLE COMPONENT STRESS AND SURFACE CONDITIONS

BACKGROUND

During drilling operations, sensors are often utilized to measure various forces exerted on a drill string. Exemplary forces include weight-on-bit and bending forces on various parts of the drill string. These forces can affect the dynamic behavior of the drill string, and if not monitored, can result in damage to downhole components or compromised operation.

For example, during drilling operations using a downhole or mud motor, the drive shaft connecting the motor to a drill bit undergoes very high bending and torque loads during rotation, and also experiences high vibration loadings. Due to these high load conditions, the drive shaft material fatigues, which can lead to crack initiation and propagation, and ultimately failure of the drive shaft.

SUMMARY

An apparatus for measuring strain on a downhole component includes: at least one strain sensitive device disposed proximate to a surface of a component of a downhole drilling assembly or disposed within a material forming the component; and a processor in operable communication with the at least one strain sensitive device, the processor configured to detect changes in the at least one strain sensitive device and detect at least one of erosion, crack formation and crack propagation in the component surface.

An apparatus for measuring strain on a downhole component includes: at least one strain gauge deposited on a surface of a drive shaft of a downhole drilling assembly or disposed within a material forming the drive shaft; and a processor in operable communication with the at least one strain gauge, the processor configured to detect changes in the at least one strain gauge and detect conditions affecting operation of the drive shaft.

A method of monitoring a drilling operation includes: disposing a drilling assembly in a borehole, the drilling assembly including at least one strain gauge disposed at or near a surface of a component of the downhole drilling assembly, or disposed within a material forming the component; performing a drilling operation; and detecting changes in the strain gauge during the drilling operation and analyzing the changes to monitor one or more loads on the component, and determining at least one of a magnitude of the one or more loads and a number of load cycles experienced during the drilling operation; and detecting conditions affecting the drilling operation based on at least one of the magnitude and the number of load cycles.

BRIEF DESCRIPTION OF THE DRAWINGS

The subject matter, which is regarded as the invention, is particularly pointed out and distinctly claimed in the claims at the conclusion of the specification. The foregoing and other features and advantages of the invention are apparent from the following detailed description taken in conjunction with the accompanying drawings, wherein like elements are numbered alike, in which:

DETAILED DESCRIPTION

Figure 1:
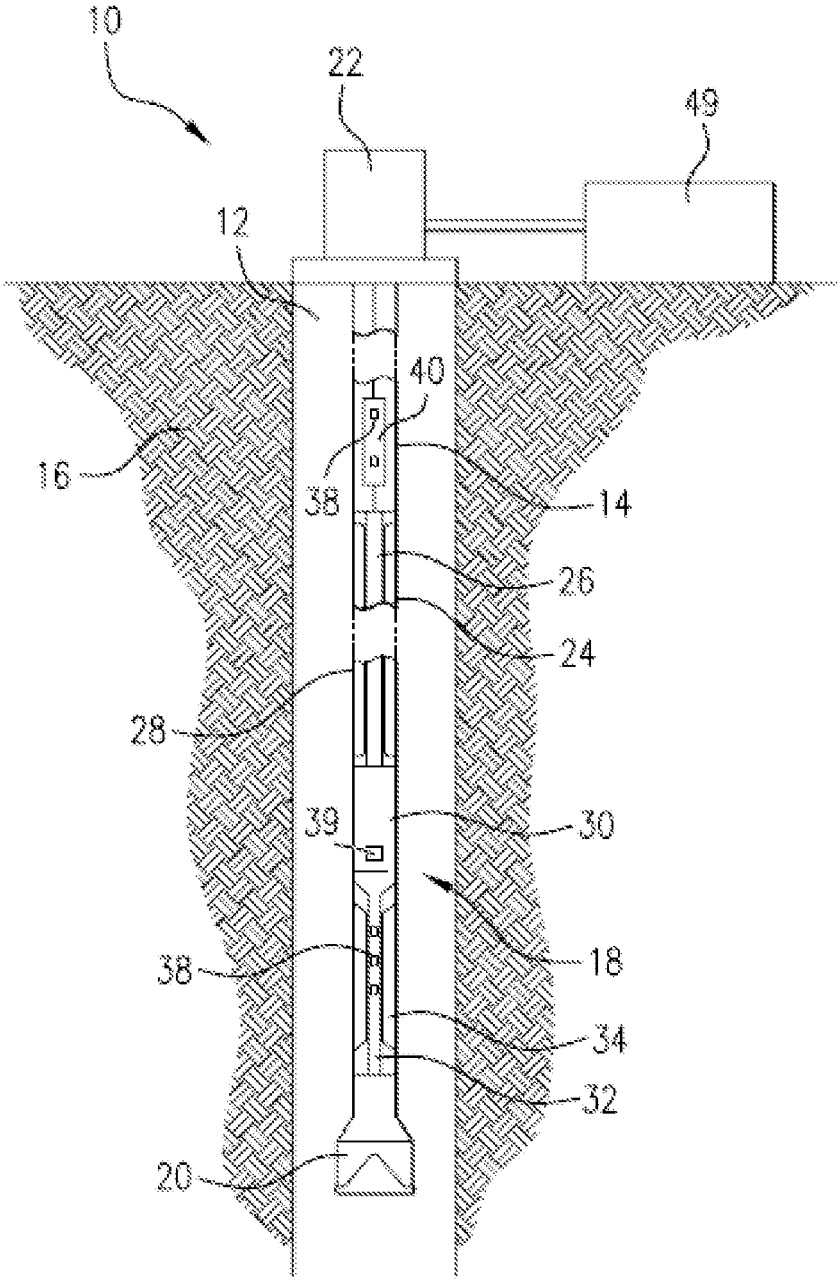
FIG. 1 is an exemplary embodiment of a drilling system including a drill string disposed in a borehole in an earth formation.

Referring to FIG. 1, an exemplary embodiment of a downhole drilling system 10 disposed in a borehole 12 is shown. A drill string 14 is disposed in the borehole 12, which penetrates at least one earth formation 16. Although the borehole 12 is shown in FIG. 1 to be of constant diameter, the borehole is not so limited. For example, the borehole 12 may be of varying diameter and/or direction (e.g., azimuth and inclination). The drill string 14 is made from, for example, a pipe, multiple pipe sections or coiled tubing. The system 10 and/or the drill string 14 include a drilling assembly 18, which may be configured as a bottomhole assembly (BHA). Various measurement tools may also be incorporated into the system 10 to affect measurement regimes such as wireline measurement applications or logging-while-drilling (LWD) applications.

The drilling assembly 18 includes a drill bit 20 that is attached to the bottom end of the drill string 14 and is configured to be conveyed into the borehole 12 from a drilling rig 22. In the embodiment shown in FIG. 1, the drill bit 20 is operably connected to a positive displacement motor 24, also described as a mud motor 24, for rotating the drill bit 20. Although the embodiments described herein include a positive displacement motor, such embodiments may include any type of downhole motor, such as a turbine motor, and are not limited to drilling motors.

The mud motor 24 includes a power section having a rotor 26 and a stator 28 disposed therein, and an optional steering mechanism 30 (e.g., an adjustable bent housing). A drive shaft 32 is connected to at least the power section to rotate the drill bit 20. A bearing assembly 34 may also be included to support the drive shaft 32. Additional bearing assemblies may also be included as part of, e.g., the power section, steering mechanism and connections between various components of the drilling assembly 18.

Figure 2:
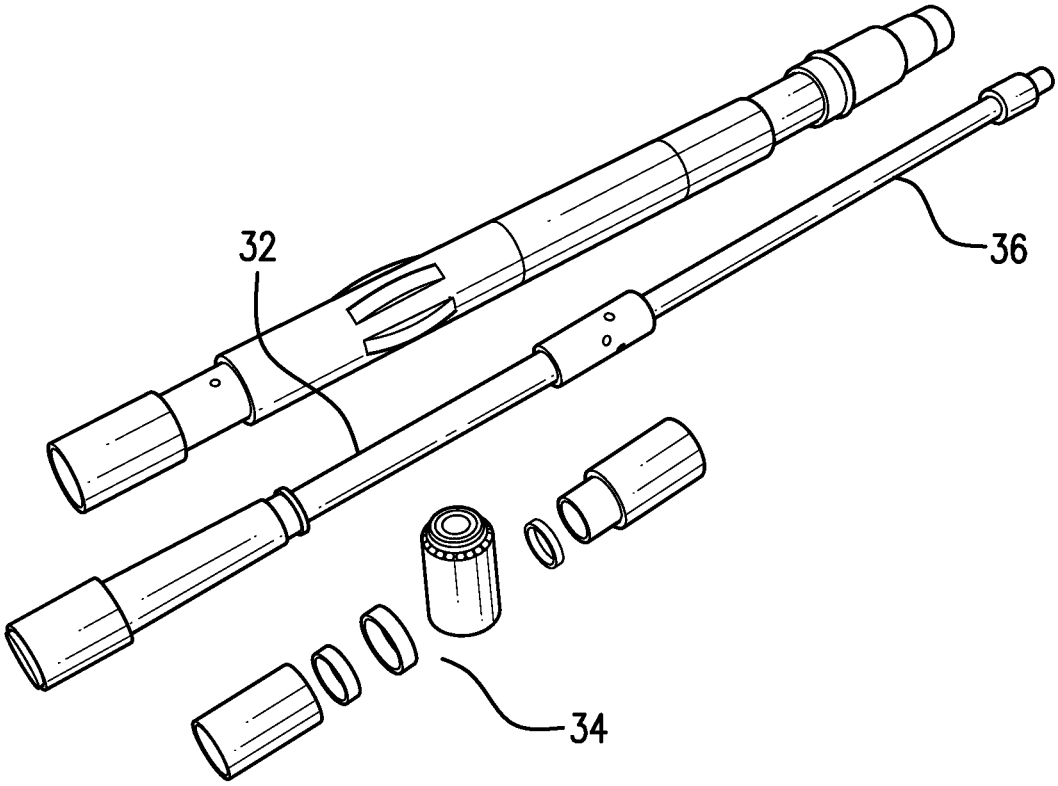
FIG. 2 is a perspective view of an exemplary drive shaft assembly.

An example of a drive shaft 32 is shown in FIG. 2, which illustrates a bit coupling assembly that includes a bearing assembly 34 and the drive shaft 32, which is connected to the motor 24 and couples the motor 24 to the drill bit 20. In one example, the drive shaft 32 is coupled to the drill bit 20 through a flex shaft 36.

Referring again to FIG. 1, various components of the drill string 14 and/or the drilling assembly 18 include one or more strain gauges 38 disposed on their respective surfaces. For example, strain gauges 38 may be disposed on one or more surfaces of the power section, the drive shaft 32, the flex shaft 36, the bearing assembly 34 or any areas that experience high loads or stress concentrations, such as pockets or recesses in the drill string (e.g., a pocket 40 for housing electronic components). Other exemplary components on which strain gauges 38 can be disposed include pin-box connectors (e.g., pin stress relief structures), drill bit bearing assemblies and/or rollers, thrust bearings, axial bearings and upper and lower radial bearings.

Figure 3:
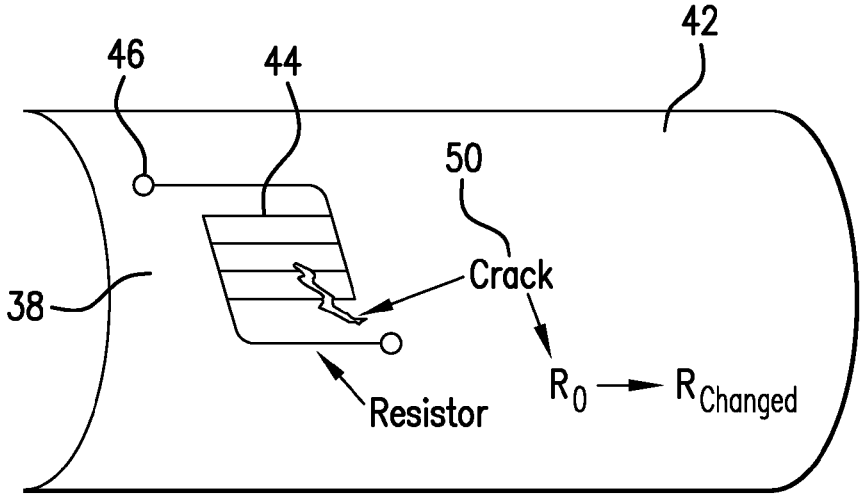
FIG. 3 is a perspective view of an embodiment of a component condition (e.g., strain, crack formation/propagation, erosion and/or abrasion) detection device or mechanism of the system of FIG. 1.

In one embodiment, each strain gauge 38 is directly deposited on the surface via, e.g., sputtering or other forms of deposition. FIG. 3 shows an example of a strain gauge 38 sputtered or otherwise deposited directly onto a surface 42 of the drive shaft 32. The strain gauge 38 in this example is a thin film deposited foil strain gauge. As shown in FIG. 3, in one embodiment, the strain gauge 38 is a sputtered or thin film strain gauge. As shown in FIG. 3, the strain gauge 38 includes conductors 44 that are deposited directly onto the drive shaft 32 (or other component) to measure the stress/strain the shaft 32 is undergoing during operation. Gauge leads 46 may be connected to the ends of the conductors 44. The strain gauge 38 may be deposited directly on the shaft 32 such that it is in direct contact with the shaft material and flush with the top surface. Any of various deposition techniques may be used to deposit the strain gauge, such as sputtering, evaporation, chemical vapor deposition, laser deposition, injection printing, screen printing, ink jet printing, lithographic patterning, electroplating and others. Although the strain gauges 38 are described herein as deposited onto a surface, such strain gauges 38 can also be applied to the surface using other techniques or mechanisms, such as gluing the strain gauge onto the surface.

As shown in FIG. 3, the strain gauges 38 can be utilized to measure strain, and also to detect and/or monitor crack formation. For example, one or more strain gauge 38 can be used to detect the formation and/or growth of a crack or other discontinuity that may form on the surface 42. For example, as a crack 50 develops under the strain gauge 38, the gauge itself is configured to crack as well (or otherwise deform), which causes a signal produced by the strain gauge 38 to indicate a change in resistance or to be cut off entirely, indicating that a crack has formed. Other conditions that can be monitored include abrasion and/or erosion of the surface, outer layers of a component or protective coatings, which can exert strain on the gauge 38 and/or cut off the gauge circuit.

In one example, the strain gauge 38 includes one or more resistive traces configured to change resistance due to breach of a trace by crack. In another example, the strain gauge includes an ultrasonic transducer including an ultrasonic wave source 39 and one or more ultrasonic detection (e.g., piezoelectric) traces 44 configured to detect changes in wave propagation that occur due to a modified surface (e.g., through erosion, abrasion, crack formation and/or crack propagation). The traces may be configured as one or more elongated traces or an array covering a selected area of the surface.

Figure 4:
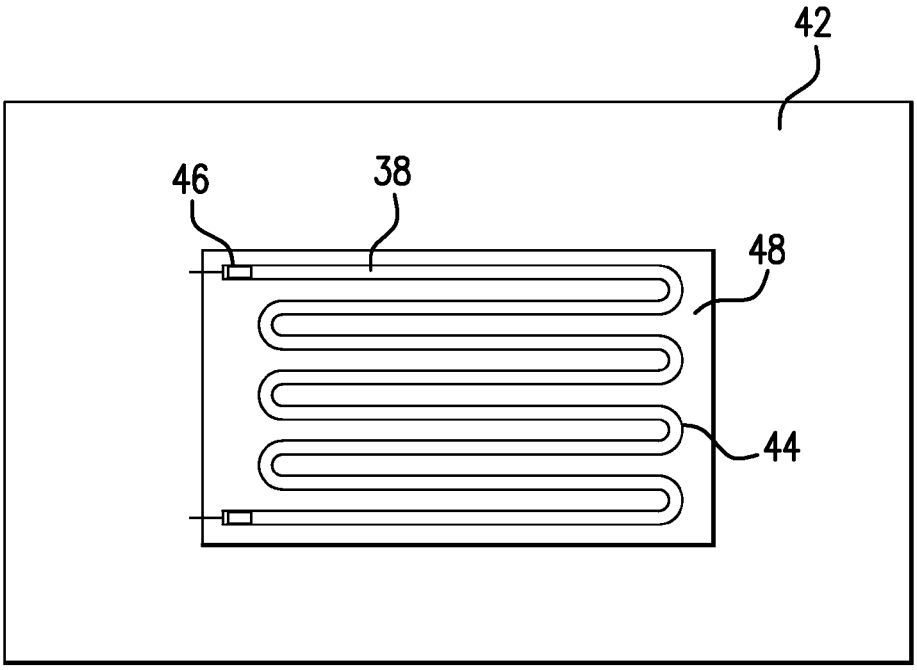
FIG. 4 is a top view of an embodiment of a strain gauge of the system of FIG. 1.

Referring to FIG. 4, the strain gauges 38 may be deposited on a thin insulation or passivation layer 48 to avoid shorting through the surface 42 if the surface is made from an electrically conductive material. If the surface is non-metallic or non-conductive (e.g., includes a pre-existing insulating coating), then a passivation layer 48 may not be needed. In one embodiment, if an insulating layer 48 is included between the strain gauge 38 and the surface, the layer 48 is made from a material that is configured to crack or otherwise deform with the surface. For example, the layer material is selected or configured to be sufficiently brittle (i.e., at least as brittle as the surface material in the operating environment) so that the layer cracks along with cracks that form in the surface. Examples of such materials include ceramic materials and oxide materials (e.g., silicon oxide, aluminum oxide and zirconium oxide). In one embodiment, one or more protective layers 60 (illustrated in FIG. 6) are disposed over the strain gauge. The protective layer may be, for example, a polymer or epoxy material, a metallic material, or any other suitable material configured to withstand temperatures found in a downhole environment.

As shown in FIGS. 3 and 4, the strain gauge 38 may include a deposited conductor 44, made from a conductive material such as a metallic material (e.g., aluminum or nichrome) or graphite. For example, the conductor is formed on the surface by directly depositing strain sensitive materials such as NiCr or CuNi. Other examples of suitable strain sensitive materials also include nickel containing diamond like carbon films and Ag-ITO compounds. The strain gauges 38 are not so limited, and can be made from any suitable material or include any mechanism sufficient generate a signal indicative of strain on a surface or within a component material or layer. In one embodiment, the strain gauge 38 includes a piezoelectric material 44 that is directly deposited on a drive shaft or other component surface using, e.g., sputtering or screen printing techniques. For example, piezoelectric materials formed as part of, e.g., ultrasonic transducers, can be directly patterned on the surface and used to detect crack propagation. If the surface is non-conductive (e.g., a composite drive shaft), the piezoelectric material can be integrated in the surface material, e.g., in the form of fibers. This can allow for load monitoring throughout the bulk of the drive shaft. The same technique can be used on other components such as pump turbine blades, stress concentration areas (e.g., pockets).

The configuration or pattern of deposited sensors are not limited to the configurations described in FIGS. 3 and 4. For example, the conductors 44 may have any suitable length that is to be monitored, e.g., may extend along the entire length of the drive shaft 32 (or other component). In one embodiment, the strain gauge 38 is configured as a single or multiple elongated conductors, piezoelectric layers and/or ultrasonic detectors extending along the length to be monitored. A continuous or grid style layer can be deposited which can be used to monitor crack propagation over a large area, and/or can also be used to monitor stress over a larger area.

The strain gauges 38 also include, or are connected to, means for communicating signals to receivers such as a user and/or a processing unit 49 located at a surface location or disposed downhole. For example, the strain gauges 38 can be designed with an antenna to power and/or interrogate the strain gauges 38 or with wires running along the shaft and connecting to electronics through the bearings (e.g., via slip rings, brush contacts). Other exemplary communication means include a radio-frequency identification (RFID) tag connected to each strain gauge 38. Other mechanisms for wireless communication from the strain and crack sensors can be based on capacitive, acoustic, optical or inductive coupling. The strain gauge 38 transmits signals to a processor in the form of, e.g., voltage changes, to a desired location. Signals and data may be transmitted via any suitable transmission device or system, such as various wireless configurations as described above and wired communications. Other techniques used to transmit signals and data include wired pipe, electric and/or fiber optic connections, mud pulse, electromagnetic and acoustic telemetry.

Figure 5:
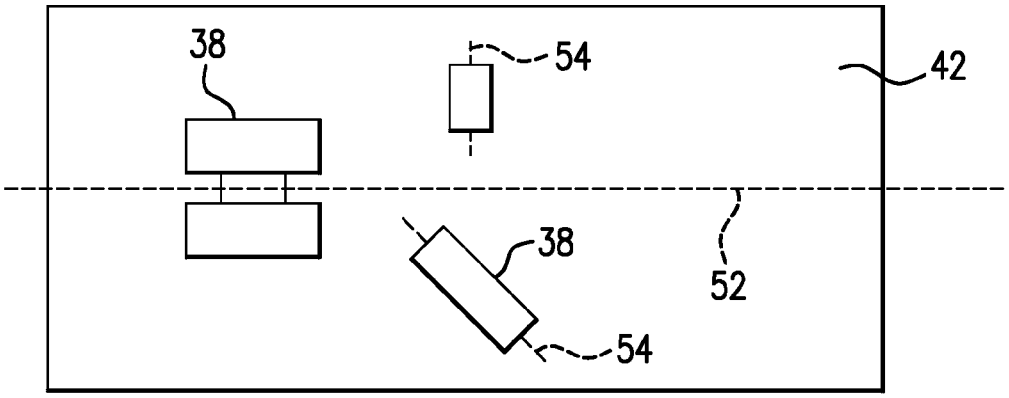
FIG. 5 is a top view of exemplary configurations of strain gauges of the system of FIG. 1.

FIG. 5 illustrates an example of various configurations than can be utilized to measure strain. For example, the strain gauges 38 can be deposited in configurations that allow for longitudinal or axial loads, lateral (bending) loads and/or torsional loads. The orientations and numbers of each strain gauge 38 are merely exemplary and not limited to those described herein.

In this example, the drill string 14 defines a central longitudinal axis 52, referred to as the "drill string axis" or "string axis". Each strain gauge also 38 defines a "strain gauge axis" or "gauge axis" 54 which corresponds to the direction of sensitivity of the conductors for which changes in resistance are measured. For strain gauges of the type illustrated herein, the strain gauge axis 54 corresponds to the direction of the elongated conductors and also to the direction of greatest sensitivity. For example, one or more gauges 38 are configured so that the gauge axis 54 is at least substantially parallel to the string axis 46, to measure axial forces that can be used to estimate parameters such as weight on bit (WOB). In another example, one or more gauges 38 are oriented so that the gauge axis 54 is at least substantially parallel to allow for estimation of, e.g., bending forces. In yet another example, one or more gauges 38 can be oriented at approximately 45 degrees relative to the string axis 52 to measure torsional strain, which can be used to estimate torque on parts of the string (e.g., TOB). An exemplary configuration includes four strain gauges that are axially oriented and positioned at 90° interval around the drive shaft for measurement of axial loads, and two strain gauges are oriented at 45° relative to the string axis for measurement of torque. It is noted that multiple assemblies and or strain gauges with different orientations can be operably connected, for example, as part of a single assembly or bridge circuit. In one embodiment, one or more strain gauges are electrically connected as part of a bridge circuit, such as a Wheatstone bridge.

Figure 6:
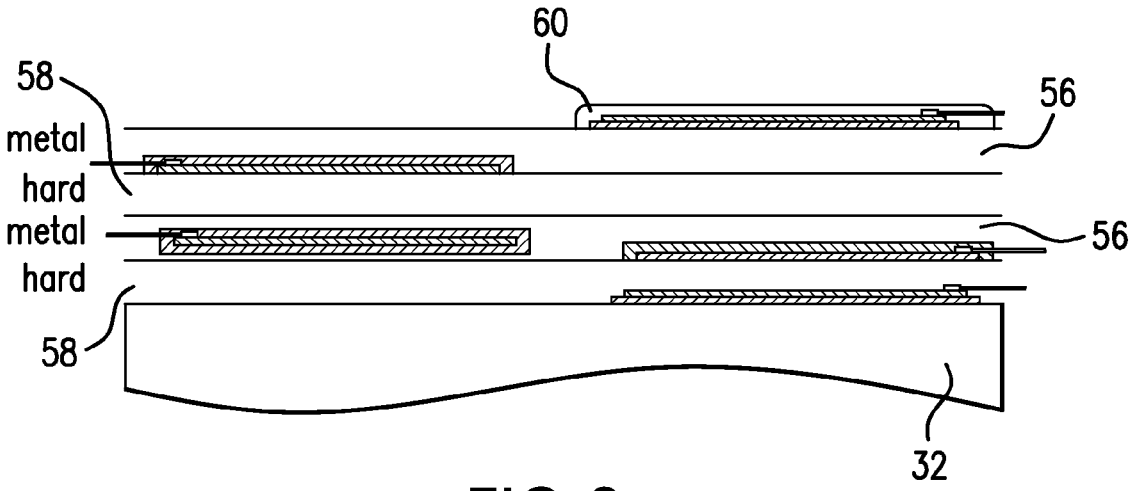
FIG. 6 is a side view of a strain sensing configuration for a multi-layer component coating.

Referring to FIG. 6, in one embodiment, multiple strain gauges 38 are installed with respective layers of a multi-level coating on a downhole component. For example, the drive shaft 32 includes a multi-layer protective coating on an exterior surface, upon which alternating layers of a metallic coating (layers 56) and a hard coating such as a ceramic or polymer coating (layers 58) are disposed or deposited. At least one thin film strain gauge 38 is sputtered or otherwise deposited on a surface of (or embedded in) each layer to monitor strain on each layer. Various conditions such as erosion, abrasion or cracking of each layer 56, 58 can be monitored. For example, when a specific layer 56, 58 is cracked or eroded, a signal from the respective gauge 38 is altered or lost entirely. This configuration can be used to, e.g., determine when a portion of a protective coating is entirely eroded (thereby exposing the surface of the drive shaft to the environment) by detecting when the innermost strain gauge signal is lost.

The embodiments of FIG. 6 may be used in conjunction with a component such as a puller that has parts which are exposed to severe erosion through the impingement of sand particles. The component can be coated with multi-level protective hard coatings with a strain and/or crack sensitive resistive layer formed as grid in between such that when a protective layer is breached, an electrical signal is generated which alerts a processor or user that a protective coating has been breached. Multi-level resistive elements will allow for the quantification of protective coating(s) that remain unbreached.

Figure 7:
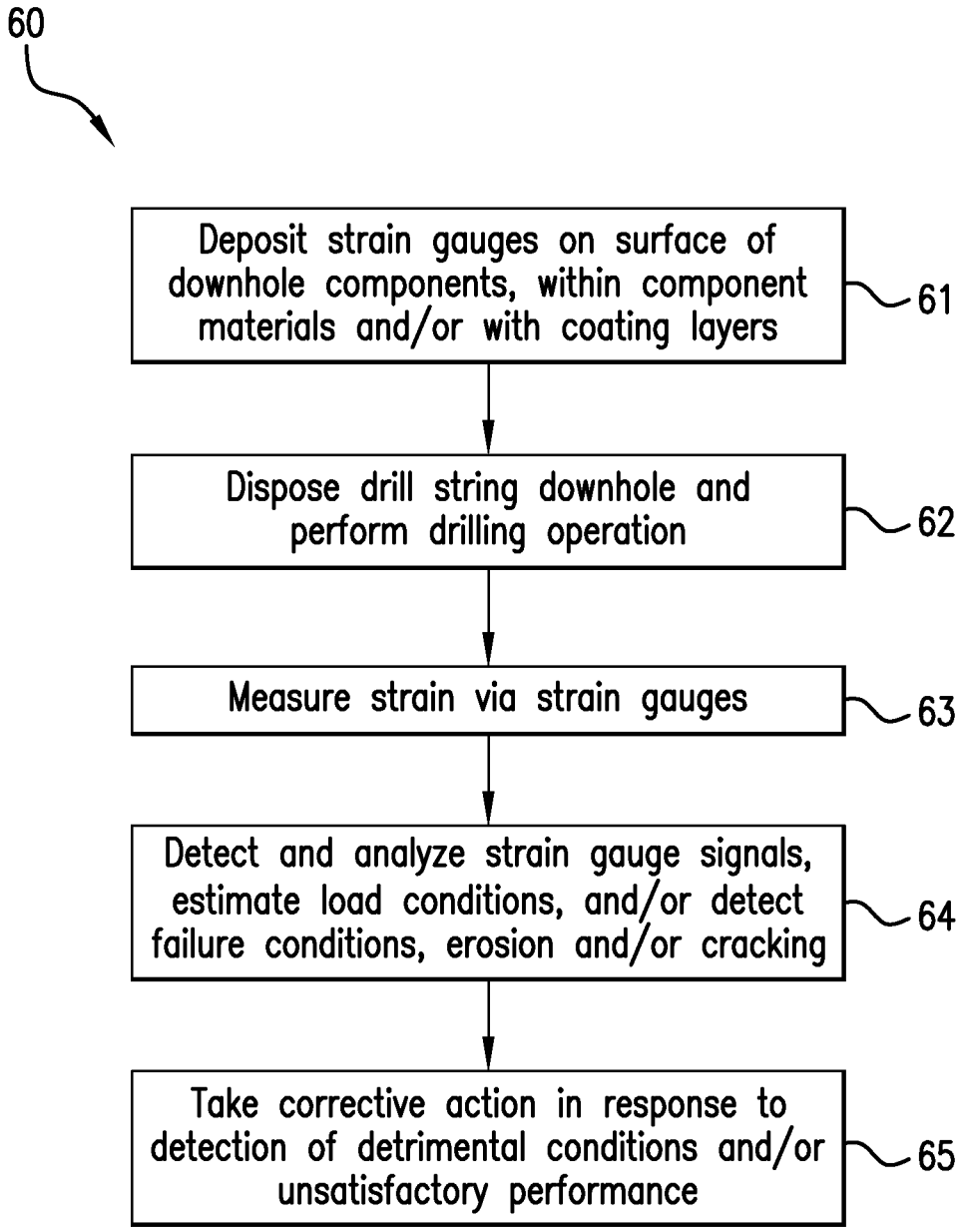
FIG. 7 is a flow chart illustrating an exemplary method of manufacturing stress monitoring systems and/or stress monitoring of downhole components.

Referring to FIG. 7, an exemplary method 60 of manufacturing stress monitoring systems and/or stress monitoring of downhole components is shown. The method 60 includes one or more stages 61-64. In one embodiment, the method 60 includes the execution of all of stages 61-64 in the order described. However, certain stages may be omitted, stages may be added, or the order of the stages changed.

In the first stage 61, strain gauges 38 are deposited on or in surfaces of the drive shaft 32 or other components. An exemplary process is a sputtered thin film deposition technique, which includes optionally depositing an insulating layer on the surface, depositing and/or etching a thin film conductor on the insulating layer, and optionally depositing or otherwise covering the conductor with a protective layer.

For example, the insulated layer is sputtered onto the surface, and the conductor is formed by depositing a thin film of a resistive alloy or metal and etching (e.g., laser etching) the film into balanced resistors. Exemplary techniques for depositing the thin film conductor and/or the insulating layer include sputtering, evaporation, pulsed laser deposition, chemical vapor deposition and others.

In this example, at least the insulating layer and the conductor are deposited as thin film layers. The insulating layer can be any suitable material, including dielectric materials such as plastics or ceramics. Exemplary insulating materials include polyimides and epoxies. Conductor materials may be any suitable conductive materials, including metals such as copper and copper alloys (e.g., Copel), platinum and platinum alloys, nickel, isoelastic alloys and others.

In the second stage 62, the string 14 and/or the drilling assembly 18 are disposed downhole, e.g., during a drilling or logging-while-drilling (LWD) operation. The string 14 may be configured as any desired type, such as a measurement string or completion string.

In the third stage 63, strain on various components of the string 14 is measured during a drilling or LWD operation (or other desired operation) by transmitting an electrical signal to the strain gauge 38 and measuring a change in resistance of the conductor 44. Transmission and detection can be performed by, for example, the processing unit 49.

In the fourth stage 64, the change in resistance (e.g., indicated by received voltage change in a strain gauge 38) is analyzed by, e.g., the processing unit 49 to determine the strain on the respective component surface. This strain information is further analyzed to measure various forces or parameters downhole, such as WOB, compressive forces, bending forces, torsional forces, crack formation, erosion and abrasion.

In one embodiment, signals from the strain gauges 38 are monitored for the presence or development of cracks or erosion on the surface of the drive shaft 32 (or other component). Crack initiation and propagation can be monitored by using the strain gauges 38, which show a modified response when a crack is in the vicinity. For example, in the case of a strain gauge including a resistive element sputtered on a drive shaft, when a surface crack breaks through the resistive element, a resistance measuring circuit can detect the location and severity of the crack. When a crack cuts through few lines of the resistive element, the severity of the crack may be given by the number of open resistive legs (i.e., an increase in overall resistance). The location of the crack may be given by the specific resistive element showing the resistance variation.

In one embodiment, strain on the drive shaft or other component is monitored to monitor loading, fatigue of the component and/or monitor the condition of the component relative to the components effective lifetime.

For example, loading on the drive shaft 32 or other component is monitored and compared to pre-existing data relating to expected loads, conditions and lifetimes. The drive shaft is expected to undergo a certain amount of stress due to loading. The stress is measured and analyzed to monitor the number of load cycles experienced by a drive shaft and the stress/strain experienced during each load cycle. As the downhole operation proceeds, the processing unit 49 counts the number of load cycles by which stress is applied to the shaft. The number of load cycles is compared to a maximum or "safe" number of load cycles that the drive shaft can safely endure (which can be estimated based on the level of torque applied). If the number of load cycles exceeds the safe number or reaches a number related to the safe number, an alert may be sent to a user or the processing unit 49 may automatically take corrective action (e.g., stopping the operation, reducing torque).

Likewise, a maximum or safe level of stress and/or torque applied to the drive shaft 32 during each load may be set, and the stress is monitored during operation. If the stress and/or torque exceeds the safe level or comes within a selected range around the safe level, an alert may be sent to a user and/or corrective action may be performed, e.g., the torque applied to the drive shaft may be reduced.

In one embodiment, the stress measured on a component (e.g., axial stress, bending) is monitored and compared to stress or load conditions that indicate an impending failure. These conditions may be predetermined based on prior operations or experimental observations. Such conditions include the number of load cycles and/or an amount of bending and torque.

In the fifth stage 65, various corrective or preventive actions are performed in response to the monitoring, e.g., if the loading conditions are determined to be detrimental to the proper functioning of the shaft. For example, if crack propagation is detected, the downhole tool is pulled and the shaft or other component on which the crack has developed is replaced to avoid unmanaged wellbore intervention. Other actions include sending an alert to a user or other controller, reducing torque or otherwise modifying operation parameters to compensate for the monitored conditions, and stopping the downhole operation. The monitoring system can also activate self-healing systems to reduce/heal cracks through chemical, mechanical or electrical processes.

The systems and methods described herein provide various advantages over prior art techniques. For example, the stress monitoring systems and methods described herein provide the ability to perform real time monitoring of stress loads on drive shafts and other components during downhole operations. Such monitoring provides the ability to detect and locate detrimental conditions and quickly react to such conditions, such as behavior indicative of impending failure, lifetime of the component, as well as erosion and development of cracks in the component.

In support of the teachings herein, various analysis components may be used, including digital and/or analog systems. The digital and/or analog systems may be included, for example, in the processing unit 49. The systems may include components such as a processor, analog to digital converter, digital to analog converter, storage media, memory, input, output, communications link (wired, wireless, pulsed mud, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a computer readable medium, including memory (ROMs, RAMs, USB flash drives, removable storage devices), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood that various changes may be made and equivalents may be substituted for elements thereof without departing from the scope of the invention. In addition, many modifications will be appreciated to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An apparatus for measuring strain on a downhole component, comprising:

at least one strain gauge deposited on a surface of the downhole component of a downhole drilling assembly or disposed within a material forming the downhole component, the strain gauge including a plurality of conductive traces connected in parallel; and a processor in operable communication with the at least one strain gauge, the processor configured to detect changes in the at least one strain gauge in response to conditions of the surface of the downhole component, the conditions of the surface including the formation of a crack or surface discontinuity, the processor configured to estimate the formation and extent of the crack or the surface discontinuity based on a number of conductive traces disrupted by the crack or the surface discontinuity.

2. The apparatus of claim 1, wherein the downhole component includes a drive shaft configured to operably connect a downhole motor to a drill bit.

3. The apparatus of claim 1, wherein the strain gauge includes a plurality of strain sensitive traces forming a network on a surface of the downhole component over a selected area.

4. The apparatus of claim 1, further comprising a plurality of layers disposed on a surface of the downhole component, the at least one strain gauge disposed at one or more of the plurality of layers.

5. The apparatus of claim 1, wherein the processor is configured to detect at least one of strain, crack formation, crack propagation, abrasion and erosion based on the changes in the at least one strain gauge.

6. The apparatus of claim 1, wherein the at least one strain gauge is deposited on the downhole component by at least one of sputtering, evaporation, chemical vapor deposition, laser deposition, ink jet printing, screen printing and electroplating.

7. The apparatus of claim 1, wherein the at least one strain gauge includes an insulating layer disposed between the at least one strain gauge and the downhole component, the insulating layer made from a material that is at least as brittle as the material forming the component when in an operating environment.

8. The apparatus of claim 1, wherein the processor is configured to monitor one or more loads on the downhole component, determine a number of load cycles experienced during a drilling operation, and detect a condition of the downhole component based on at least one of the one or more loads and the number of load cycles.

9. The apparatus of claim 1, wherein the change include a change in acoustic wave transmission occurring in the downhole component due to surface modifications caused by the at least one of crack formation in the downhole component and crack propagation in the downhole component.

10. The apparatus of claim 9, wherein the strain gauge is configured as an acoustic transducer for detection of acoustic wave propagation in the downhole component.

11. The apparatus of claim 1, wherein the strain gauge includes at least one electrical conductor deposited on the surface, and the processor is configured to detect the changes based on a change in resistance due to modification or disruption of the strain gauge.

12. The apparatus of claim 11, wherein the strain gauge includes a plurality of conductive traces disposed on the surface, and the processor is configured to estimate the formation and severity of the crack or the surface discontinuity based on a number of conductive traces disrupted by the crack or the surface discontinuity.

13. The apparatus of claim 12, wherein the strain gauge includes a piezoelectric material deposited on the surface and configured to detect acoustic waves generated by an acoustic wave source, and the processor is configured to detect the changes based on a change in acoustic wave transmission detected by the piezoelectric material due to the conditions of the surface of the downhole component.

14. An apparatus for measuring strain on a downhole component, comprising:

at least one strain gauge deposited on a surface of a downhole component of a downhole drilling assembly or disposed within a material forming the downhole component, the at least one strain gauge including an insulating layer disposed between the at least one strain gauge and the downhole component, the insulating layer made from a material that is at least as brittle as the material forming the downhole component when in an operating environment; and a processor in operable communication with the at least one strain gauge, the processor configured to detect changes in the at least one strain gauge in response to conditions of the surface of the downhole component, the conditions of the surface including the formation of a crack or surface discontinuity.

15. The apparatus of claim 14, wherein the strain gauge includes a plurality of conductive traces connected in parallel, and the processor is configured to estimate the formation and extent of the crack or the surface discontinuity based on a number of conductive traces disrupted by the surface discontinuity.

16. An apparatus for measuring strain on a downhole component, comprising:

at least one strain gauge deposited on a surface of a downhole component of a downhole drilling assembly or disposed within a material forming the downhole component; and a processor in operable communication with the at least one strain gauge, the processor configured to detect changes in the at least one strain gauge in response to conditions of the surface of the downhole component, the conditions of the surface including the formation of a crack or surface discontinuity, the changes including a change in acoustic wave transmission occurring in the downhole component due to surface modifications caused by the at least one of the crack formation in the downhole component and crack propagation in the downhole component.

* * * * *